US012378028B2

(12) United States Patent
Sei

(10) Patent No.: US 12,378,028 B2
(45) Date of Patent: Aug. 5, 2025

(54) PACKAGING APPARATUS

(71) Applicant: ISHIDA CO., LTD., Kyoto (JP)

(72) Inventor: Keisuke Sei, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 18/324,165

(22) Filed: May 26, 2023

(65) Prior Publication Data

US 2023/0391489 A1 Dec. 7, 2023

(30) Foreign Application Priority Data

Jun. 1, 2022 (JP) ..... 2022-089782

(51) Int. Cl.

| | |
|---|---|
| ***B65B 57/02*** | (2006.01) |
| ***B65B 9/08*** | (2012.01) |
| ***B65B 41/16*** | (2006.01) |
| ***B65B 61/02*** | (2006.01) |

(52) U.S. Cl.

CPC ..... *B65B 57/02* (2013.01); *B65B 9/08* (2013.01); *B65B 41/16* (2013.01); *B65B 61/025* (2013.01)

(58) Field of Classification Search

CPC ..... B65B 57/02; B65B 57/08; B65B 41/18; B65B 3/005; B65B 3/00; B65B 61/025; B65B 61/26; B65H 23/00; B65H 23/18; B65H 59/10

See application file for complete search history.

(56) References Cited

U.S. PATENT DOCUMENTS

| | | | | | |
|---|---|---|---|---|---|
| 3,724,733 | A * | 4/1973 | Schaffer | B65H 23/1888 | 226/25 |
| 3,762,125 | A * | 10/1973 | Prena | B65B 7/164 | 226/27 |
| 3,788,028 | A * | 1/1974 | Folkesson | B65B 41/18 | 226/102 |
| 4,288,965 | A | 9/1981 | James | | |
| 4,893,763 | A * | 1/1990 | Wales | B65H 75/08 | 242/534 |
| 5,130,724 | A * | 7/1992 | Crowley | B65H 5/34 | 271/265.01 |
| 5,860,616 | A * | 1/1999 | Lamothe | B65H 23/26 | 242/564.3 |

(Continued)

FOREIGN PATENT DOCUMENTS

| | | |
|---|---|---|
| EP | 0905054 A1 | 3/1999 |
| JP | 2008-127093 A | 6/2008 |

(Continued)

OTHER PUBLICATIONS

Search Report from the corresponding European Patent Application No. 23176303.8 issued on Oct. 27, 2023.

*Primary Examiner* — Gloria R Weeks
(74) *Attorney, Agent, or Firm* — United IP Counselors, LLC

(57) ABSTRACT

A bagmaking and packaging apparatus includes a film supply unit that conveys a film, a printing unit, a speed detector, and a control unit. The printing unit applies laser light to the film to print the film. The speed detector acquires data relating to the conveyance speed of the film. The control unit links the operation of the printing unit when printing the film to the conveyance speed of the film based on the data from the speed detector.

4 Claims, 6 Drawing Sheets

(56) References Cited

U.S. PATENT DOCUMENTS

| | | | | | |
|---|---|---|---|---|---|
| 6,164,200 | A * | 12/2000 | Mathea | B41J 11/42 | 101/227 |
| 6,655,275 | B2 * | 12/2003 | Mugrauer | B41J 2/01 | 101/228 |
| 7,337,980 | B2 * | 3/2008 | Schaedel | B65B 61/025 | 235/475 |
| 7,955,456 | B2 * | 6/2011 | Fischer | B65B 51/16 | 156/64 |
| 8,186,896 | B2 * | 5/2012 | Frost | B65B 41/16 | 400/605 |
| 2004/0011008 | A1 * | 1/2004 | Hiramoto | B29C 66/8242 | 53/570 |
| 2005/0061419 | A1 * | 3/2005 | Send | B65B 41/12 | 156/64 |
| 2006/0249620 | A1 * | 11/2006 | Huil | B65H 16/02 | 242/563.2 |
| 2013/0199128 | A1 * | 8/2013 | Rochon | B65B 9/04 | 53/131.5 |
| 2015/0291300 | A1 * | 10/2015 | Brandt Sanz | B65B 41/16 | 53/64 |
| 2018/0016047 | A1 | 1/2018 | Miyamoto et al. | | |
| 2020/0223574 | A1 * | 7/2020 | Tong | B65B 59/00 | |
| 2022/0041394 | A1 * | 2/2022 | Shourvarzi | B65B 41/18 | |
| 2023/0159206 | A1 * | 5/2023 | Komai | B65B 7/164 | 53/64 |

FOREIGN PATENT DOCUMENTS

| | | | | |
|---|---|---|---|---|
| JP | 2010-036933 | A | 2/2010 | |
| JP | 2021-189660 | * | 11/2021 | B65B 7/28 |
| WO | 03/072439 | A1 | 9/2003 | |

* cited by examiner

PACKAGING APPARATUS

CROSS-REFERENCE TO RELATED APPLICATIONS

This application claims priority to, and the benefit of, Japanese Patent Application No. 2022-089782, filed Jun. 1, 2022, the contents of which are incorporated by reference herein in their entirety.

BACKGROUND

Technical Field

The present invention relates to a packaging apparatus.

Related Art

Conventionally, packaging apparatus, such as disclosed in JP 2010-036933A, are known. The packaging apparatus use a film, which is a packaging material, to package packaging articles. The packaging apparatus also include a printing device that prints on the film.

BRIEF SUMMARY

In packaging apparatus, the conveyance speed of the film sometimes changes. In order to ensure the quality of printing on the film, conventional packaging apparatus performs printing when the film is stopped or when the conveyance speed of the film does not change.

However, when there are restrictions on the timing of printing on the film, the operating efficiency of the packaging apparatus is sometimes reduced.

It is an object of the present invention to provide a packaging apparatus that can raise operating efficiency.

A packaging apparatus of a first aspect uses a film to package articles and includes a conveyance unit, a laser printing device, a first information acquisition unit, and a control unit. The conveyance unit conveys the film. The laser printing device applies light to the film to print the film. The first information acquisition unit acquires first information relating to the conveyance speed of the film. The control unit links the operation of the laser printing device when printing the film to the conveyance speed of the film based on the first information.

In this packaging apparatus, the operation of the laser printing device is linked to the conveyance speed of the film, so the film can be printed while maintaining printing quality even at a timing when the conveyance speed of the film changes. Consequently, limitations on the timing of printing that had existed in conventional packaging apparatus are eliminated, and it becomes possible to raise the operating efficiency of the packaging apparatus.

A packaging apparatus of a second aspect is the packaging apparatus of the first aspect, wherein the conveyance unit has a rotating member. The first information acquisition unit acquires the rotational speed of the rotating member as the first information.

Here, the rotational speed of the rotating member of the conveyance unit that conveys the film is acquired as the first information relating to the conveyance speed of the film. The rotational speed of the rotating member is information whose reliability is high as the first information, and according to this packaging apparatus, the quality of the printing on the film can be raised.

A packaging apparatus of a third aspect is the packaging apparatus of the first aspect, further including a first member. The first member contacts the film and rotates in accompaniment with the conveyance of the film. The first information acquisition unit acquires the rotational speed of the first member as the first information.

Here, the packaging apparatus is provided with the first member that contacts the film, and the rotational speed of the first member that rotates in accompaniment with the conveyance of the film is acquired as the first information. According to this packaging apparatus, the first member that contacts the film is used to directly obtain the first information relating to the conveyance speed of the film, so the reliability of the first information becomes higher and the quality of the printing on the film can be raised.

A packaging apparatus of a fourth aspect is the packaging apparatus of the third aspect, wherein the first member is pressed against the film near a printed portion of the film printed by the laser printing device.

Here, the first member is disposed near the printed portion of the film, and the rotational speed of the first member is acquired as the first information relating to the conveyance speed of the film. According to this packaging apparatus, the operation of the laser printing device is controlled so as to be linked to the conveyance speed of the film near the printed portion, so the quality of the printing on the film can be raised even more.

A packaging apparatus of a fifth aspect is the packaging apparatus of any of the first aspect to the fifth aspect, wherein when the conveyance speed of the film when the laser printing device starts printing the film changes in the middle of printing the film, the laser printing device changes the operation of printing the film in accordance with the change in the conveyance speed of the film.

Here, whether or not the conveyance speed of the film has changed in the middle of printing the film is monitored, and when the conveyance speed of the film changes, the operation of the printing the film is changed in accordance with the change. According to this packaging apparatus, the operation of printing the film finely changes, so the quality of printing on the film can be raised even more.

According to the packaging apparatus pertaining to the present invention, operating efficiency can be raised.

DETAILED DESCRIPTION

A bagmaking and packaging apparatus 102 pertaining to an embodiment of the invention and a weighing, bagmaking, and packaging system 100 including the bagmaking and packaging apparatus 102 will be described below with reference to the drawings.

Figure 1:
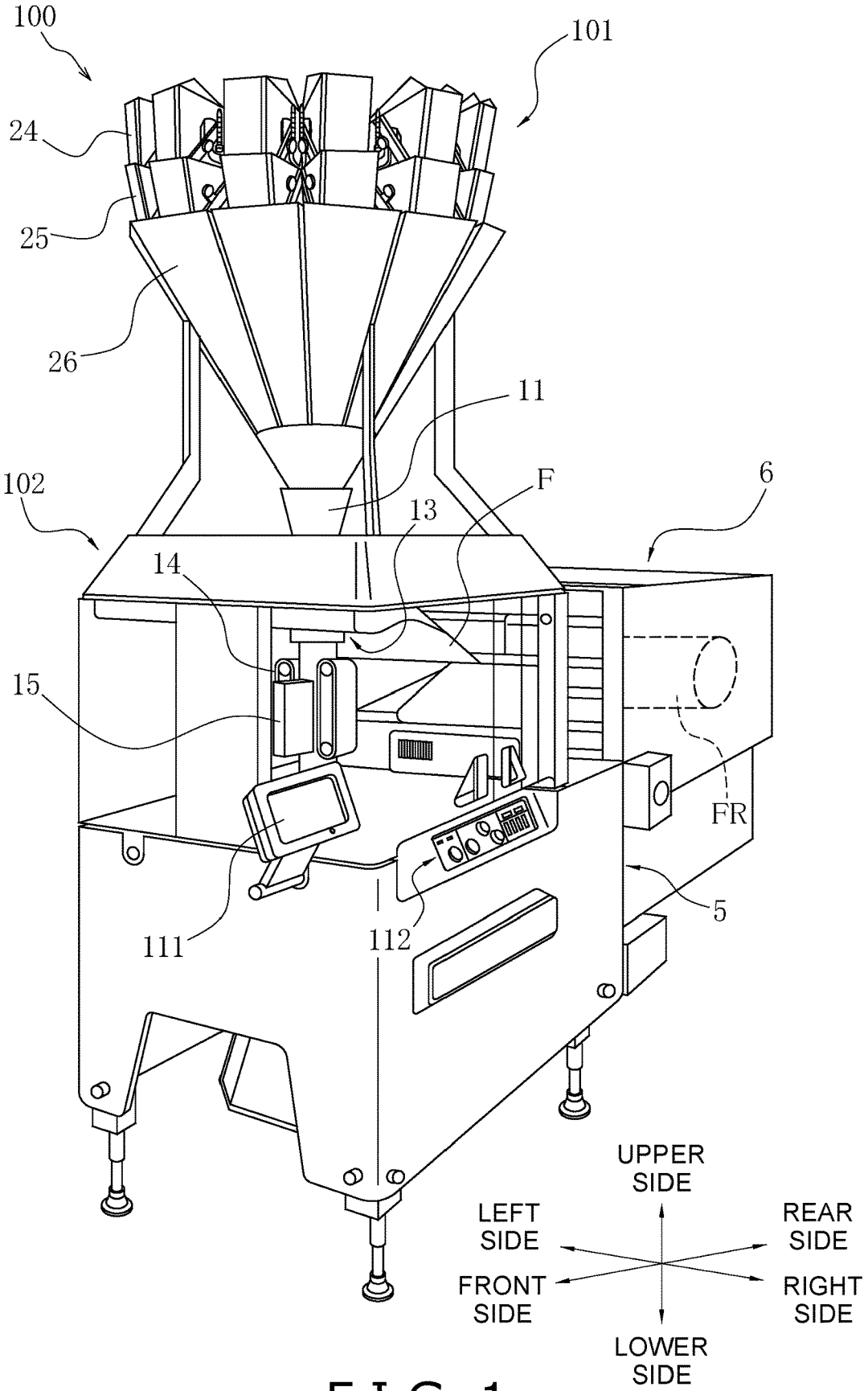
FIG. 1 is an external view of a weighing, bagmaking, and packaging system including a bagmaking and packaging apparatus.

FIG. 1 shows an external perspective view of the weighing, bagmaking, and packaging system 100. The weighing, bagmaking, and packaging system 100 is a system comprising a weighing apparatus 101 and the bagmaking and packaging apparatus 102. The weighing, bagmaking, and packaging system 100 has a configuration where the bagmaking and packaging apparatus 102 is disposed on bottom and the weighing apparatus 101 is disposed on top, and a touch panel 111 and operation switches 112 with which the bagmaking and packaging apparatus 102 and the weighing apparatus 101 can be integrally operated are provided on the right side.

The weighing apparatus 101 is a combination weigher with a known configuration. Articles that are the object of packaging by the bagmaking and packaging apparatus 102 are a snack food such as potato chips, for example, and they are supplied to the central upper portion of the weighing apparatus 101. The articles supplied to the central upper portion are dispersed to plural radial paths and are thereafter supplied via plural pool hoppers 24 disposed at terminal ends of the paths to corresponding weigh hoppers 25 below. The weights of the articles weighed by the weigh hoppers 25 are combined, and an optimum combination of the weigh hoppers 25 forming a fixed weight of the articles is selected. The selected weigh hoppers 25 discharge the articles to a collection chute 26 based on a discharge request signal from the bagmaking and packaging apparatus 102. The discharged articles form long vertical lines while falling down the collection chute 26, pass through a funnel member 11 of the bagmaking and packaging apparatus 102, and fall to an inside space of a tube 12. The group of articles fall through the inside space of the tube 12 as packaging articles C. The bagmaking and packaging apparatus 102 performs bagmaking by containing the packaging articles C inside a tubular film TF and transversely sealing the lower end portion of the tubular film TF and the upper end portion of a preceding bag B at the same time (see FIG. 2).

(1) Overall Configuration of Bagmaking and Packaging Apparatus

The bagmaking and packaging apparatus 102 is configured by a packaging unit 5 that packs the packaging articles C in bags to make products, a film supply unit 6 that supplies a film F to the packaging unit 5, a printing unit 7 (see FIG. 3), a speed detector 80 (see FIG. 3), and a control unit 110 (see FIG. 4) that controls actions of drive units of the units 5, 6, 7 and printing operations. The film supply unit 6 is a unit that supplies the sheet-like film F to a forming mechanism 13 of the packaging unit 5, and is provided adjacent to the rear side of the packaging unit 5. The printing unit 7 is a unit for printing on the film F supplied from the film supply unit 6 to the packaging unit 5. The speed detector 80 is a device that measures, near the printing unit 7, the moving speed of the film F supplied from the film supply unit 6 to the packaging unit 5.

(2) Packaging Unit

The packaging unit 5 includes a forming mechanism 13 that forms the sheet-like film F into the tubular film TF, pull-down belt mechanisms 14 that convey downward the film formed in the tubular shape (the tubular film TF), a longitudinal sealing mechanism 15 that longitudinally seals, on the front side, an overlapping portion TF-1 where both edges of the tubular film TF overlap, and a transverse sealing mechanism 17. The transverse sealing mechanism 17 transversely seals bags B made of the tubular film TF and heat-seals the upper end portion of a bag B and the lower end portion of a trailing bag (the tubular film TF) at the same time. Furthermore, the packaging unit 5 has a tube 12 around whose outer periphery the tubular film F becomes wrapped and which guides the packaging articles C into the tubular film TF.

(2-1) Forming Mechanism

The forming mechanism 13 comprises the tube 12 and a former 13*a* disposed surrounding the lower portion of the tube 12. The former 13*a* has a shape that allows the sheet-like film F to become wrapped around the periphery of the tube 12 (see FIG. 2). The sheet-like film F, which is paid out from a film roll FR retained in the film supply unit 6, becomes formed in a tubular shape when it passes through a gap between the former 13*a* and the tube 12, with the top surface of the film F becoming the inner peripheral surface of the tubular film TF and the bottom surface of the film F becoming the outer peripheral surface of the tubular film TF.

(2-2) Pull-Down Belt Mechanisms

Figure 2:
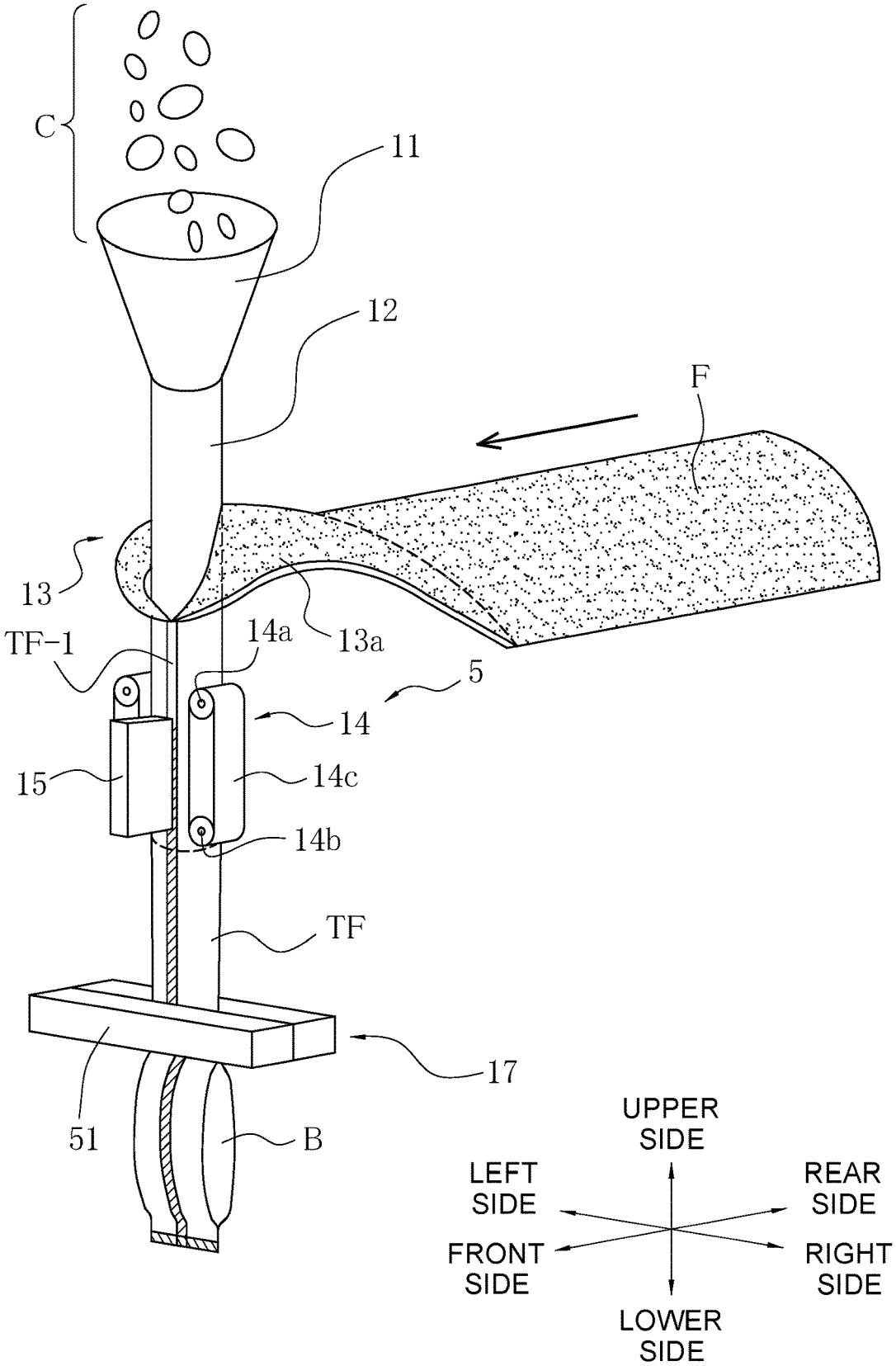
FIG. 2 is a schematic perspective view showing main configurations of the bagmaking and packaging apparatus.

The pull-down belt mechanisms 14, which have a pair of belts 14*c* disposed on both right and left sides of the tube 12, are mechanisms that suck hold of and convey downward the tubular film TF wrapped around the tube 12. As shown in FIG. 2, the pair of belts 14*c* are provided on either side of the tube 12. In each pull-down belt mechanism 14, the belt 14*c*, which has a suction function, is rotated by a drive roller 14*a* and a follower roller 14*b* to move the tubular film TF downward. In FIG. 2, illustration of roller drive motors for causing the drive rollers 14*a* and the like to rotate is omitted.

The pull-down belt mechanisms 14, together with the film supply unit 6, function as a conveyance unit that conveys the film F.

(2-3) Longitudinal Sealing Mechanism

The longitudinal sealing mechanism 15 applies heat to and seals, while pressing with a fixed pressure against the tube 12, the overlapping portion TF-1 where both edges of the tubular film TF overlap. The longitudinal sealing mechanism 15 is configured by a heater block and a metal belt that travels, synchronously with the tubular film TF, around the heater block.

(2-4) Transverse Sealing Mechanism

The transverse sealing mechanism 17 transversely seals the tubular film TF, in a state in which the packaging articles C have fallen through the tube 12 into the tubular film TF, to form the bags B filled with the packaging articles C. The transverse sealing mechanism 17 is configured by a pair of sealing jaws 51, which have built-in heaters, and drive mechanisms (not shown in the drawings), which move the pair of sealing jaws 51 toward and away from each other relative to the tubular film TF. One of the sealing jaws 51 has a built-in cutter (not shown in the drawings) that is activated to vertically separate the bag B on the lower end of the tubular film TF from the trailing tubular film TF.

(3) Film Supply Unit

The film supply unit 6, which functions as a conveyance unit that conveys the film F, mainly has a film roll retention unit 60*a* and rollers 61*a* to 61*g*, 65*a*, 65*b* that guide the film F.

Figure 3:
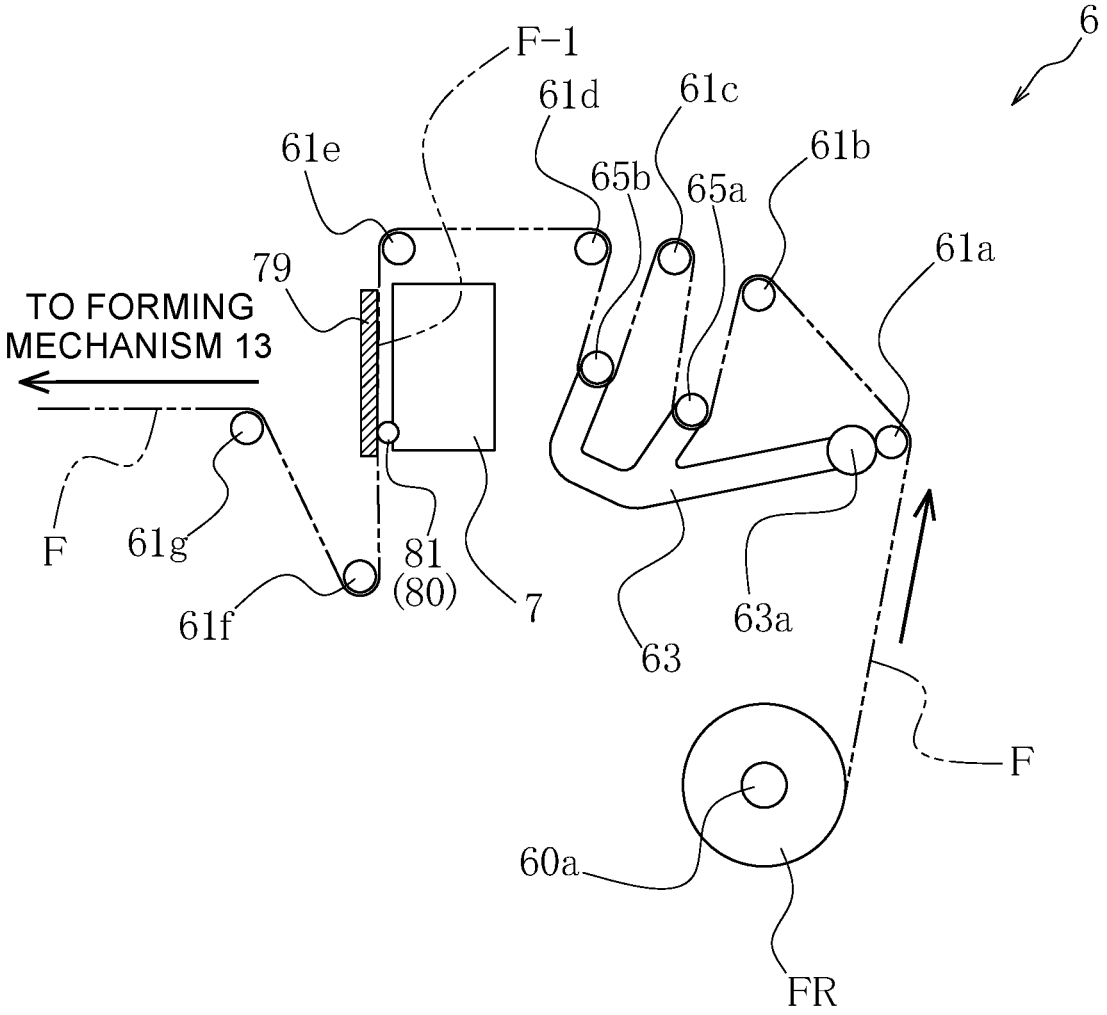
FIG. 3 is a diagram showing a moving path of a film near a film supply unit, a printing unit, and a laser absorption plate of the bagmaking and packaging apparatus.

The film roll retention unit 60*a* is a shaft that retains a film roll FR around which is wound the sheet-like film F that is the material (packaging material) of the bags B. As shown in FIG. 3, the film roll retention unit 60*a* is disposed most upstream in the conveyance path of the film F in the bagmaking and packaging apparatus 102. The film roll retention unit 60*a* is rotated by the activation of a roll drive motor (not shown in the drawings). When the film roll retention unit 60*a* rotates, the film F is paid out from the film roll FR. The film F pulled out from the film roll FR is guided by the rollers 61*a* to 61*g*, 65*a*, as shown in FIG. 3 and conveyed to the forming mechanism 13.

Of the rollers 61*a* to 61*g*, 65*a*, 65*b*, the rollers 65*a*, 65*b* fulfill the role of adjusting the magnitude of tension acting on the film F. The rollers 65*a*, 65*b* are rotatably supported by shafts on two distal end portions of an arm 63, and the shafts move in accordance with the rotation of the arm 63. The arm 63 pivots about a rotational shaft 63*a* secured to a frame.

(4) Printing Unit and Laser Absorption Plate

The printing unit 7 performs printing by continuously oscillating laser light, moving the spot of the laser light, and causing a printing layer of the film F to emit light. The printing unit 7 mainly has a laser emitter 71, an optical mechanism including a mirror drive motor 72, and a data storage unit 73 (see FIG. 4). The laser emitter 71 emits the laser light. The mirror drive motor 72 of the optical mechanism is controlled by the control unit 110 based on printing data described later. The mirror included in the optical mechanism changes the direction of the laser light emitted from the laser emitter 71 to cause the laser light to follow a predetermined path. The data storage unit 73 stores printing data relating to printing and the like. The printing data are preset for printing on the film F and are input from the outside or input from the touch panel 111 and the like. The printing data include the path of the spot of the laser light for printing.

Figure 6:
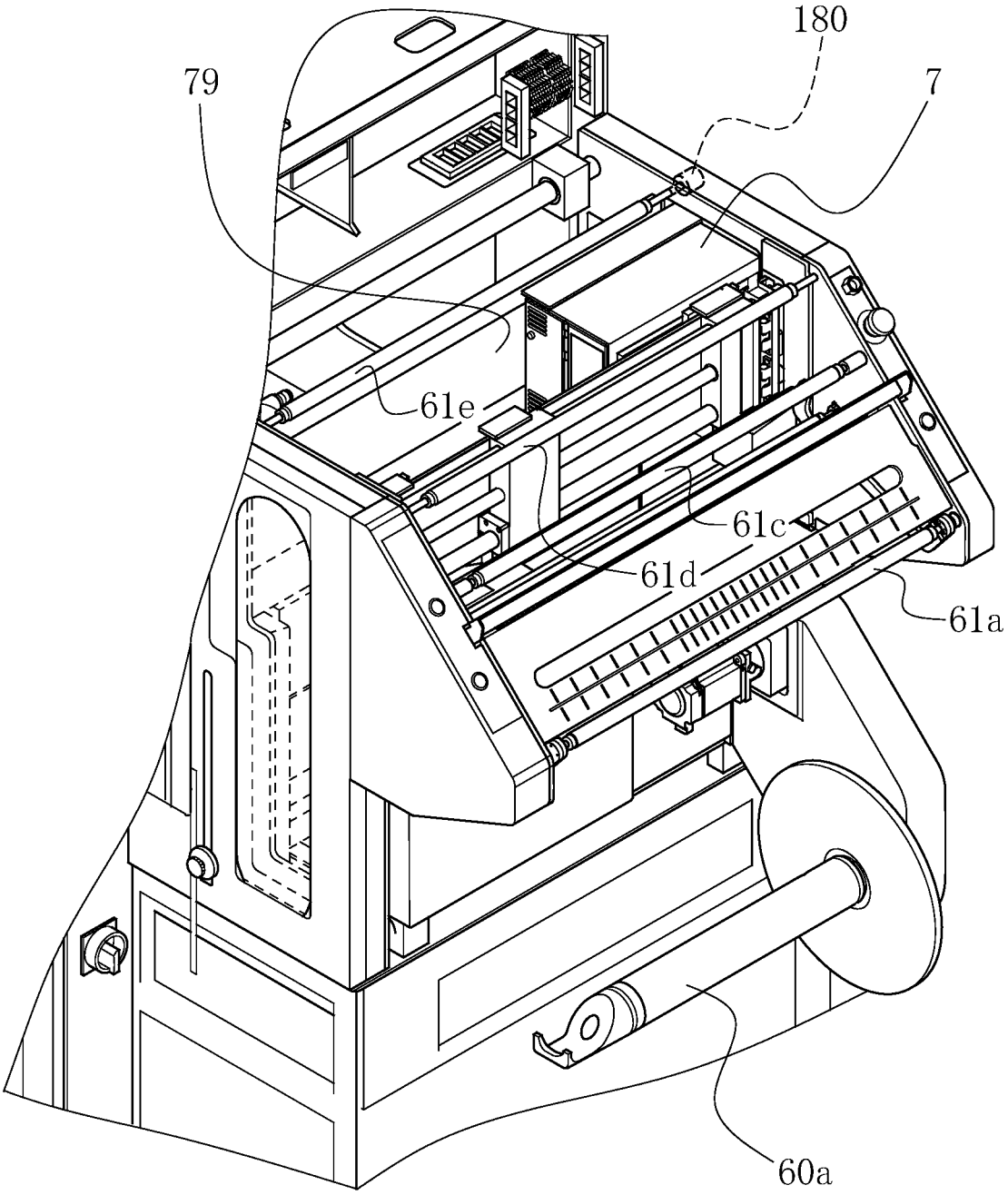
FIG. 6 is a drawing showing the disposition of an encoder in example modification B.

The printing unit 7 is disposed so that the laser light is emitted from back to front relative to a printed portion F-1 of the film F bridging the roller 61*e* and the roller 61*f* (see FIG. 3 and FIG. 6).

The laser absorption plate 79 is a member that forms a pair with the printing unit 7, and is disposed on the opposite side of the printing unit 7 across the printed portion F-1 of the film F extending in the vertical direction (see FIG. 3). The laser absorption plate 79 is provided in order to inhibit the laser light emitted from the printing unit 7 from being reflected or dispersed.

(5) Speed Detector

The speed detector 80, which performs measurements relating to the conveyance speed of the film F, has a wheel 81 that contacts with the film F as shown in FIG. 3. The wheel 81, which is a rotating body, is pressed against the laser absorption plate 79 by a spring member (not shown in the drawings). Because of this, the wheel 81 rotates in accompaniment with the movement of the film F in a state in which it is pressed against the film F. The wheel 81 is pressed against the film F near the printed portion F-1 of the film F that the printing unit 7 prints. Specifically, the wheel 81 is disposed on a portion on the right side (the near side in FIG. 3) of the printed portion F-1 of the film F.

The speed detector 80 is a device that measures the rotational speed of the wheel 81 and outputs the obtained measurement data. The speed detector 80 sends to the control unit 110 the measurement data relating to the conveyance speed of the film F. That is, the speed detector 80 acquires, as the measurement data, the rotational speed of the wheel 81 rotating in accompaniment with the conveyance of the film F and sends the measurement data to the control unit 110.

(6) Control Unit

The control unit 110, which controls the bagmaking and packaging apparatus 102, will be described below. The control unit 110 doubles as a control unit for the weighing apparatus 101 as mentioned above.

Figure 4:
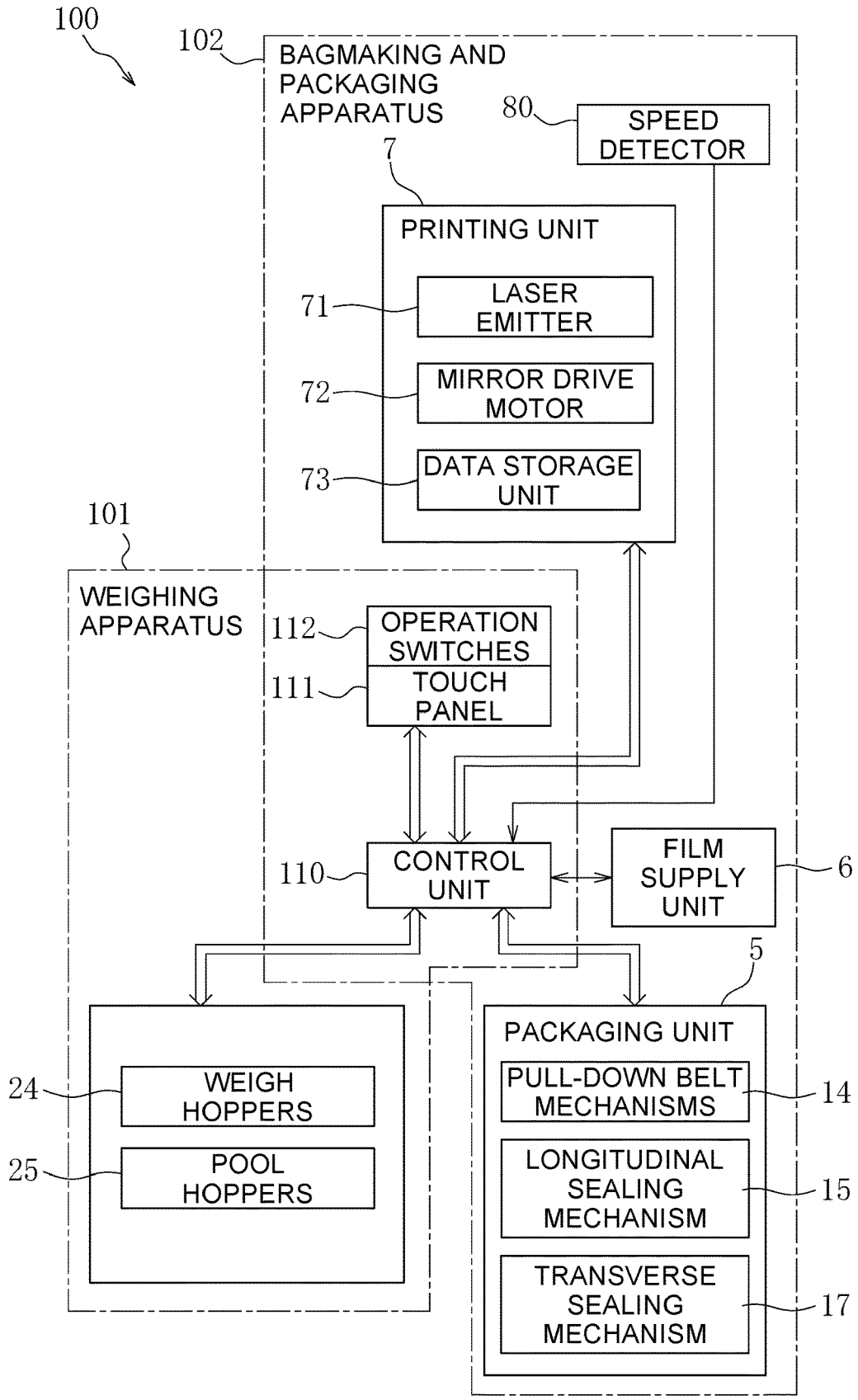
FIG. 4 is a control block diagram of the weighing, bagmaking, and packaging system.

FIG. 4 is a block diagram relating to the control of the weighing, bagmaking, and packaging system 100. The control unit 110 individually or integrally controls the weighing apparatus 101 and the bagmaking and packaging apparatus 102, and is realized by a computer. The control unit 110 includes a control arithmetic unit and a storage device. For the control arithmetic unit, a processor such as a CPU or a GPU can be used. The control arithmetic unit reads programs stored in the storage device and performs predetermined image processing and arithmetic processing in accordance with the programs. Moreover, the control arithmetic unit can write arithmetic results in the storage device and read information stored in the storage device in accordance with the programs.

The control unit 110 controls the drive units of the packaging unit 5 and the film supply unit 6 in accordance with operating conditions and parameters set using the touch panel 111 or the like. The control unit 110 also controls feeders, the pool hoppers 24, and the weigh hoppers 25 of the weighing apparatus 101. Specifically, the control unit 110 imports necessary information from various sensors installed in the weighing apparatus 101 and the bagmaking and packaging apparatus 102 and performs various types of control based on the information. The control unit 110 also receives the measurement data from the speed detector 80 and performs control to link the operation of the printing unit 7 when printing the film F to the conveyance speed of the film F.

(7) Operations of Bagmaking and Packaging Apparatus (7-1) General Overall Operations Each operation described below is an operation executed as a result of the control unit 110 controlling each mechanism and each part.

As shown in FIG. 2, the sheet-like film F is formed in a tubular shape by the forming mechanism 13 and is thereafter wrapped around the periphery of the tube 12 and formed into the tubular film TF. The tubular film TF wrapped around the tube 12 is continuously or intermittently pulled down by the pair of belts 14*c* disposed on both sides of the tubular film TF. The place (the overlapping portion TF-1) where the edge portions on both sides of the tubular film TF meet is longitudinally sealed by the longitudinal sealing mechanism 15. The tubular film TF is transversely sealed by the transverse sealing mechanism 17, whereby an upper seal portion of a bag B and a lower seal portion of a trailing bag B (the tubular film TF) are formed.

(7-2) Printing Operations of Printing Unit

Figure 5:
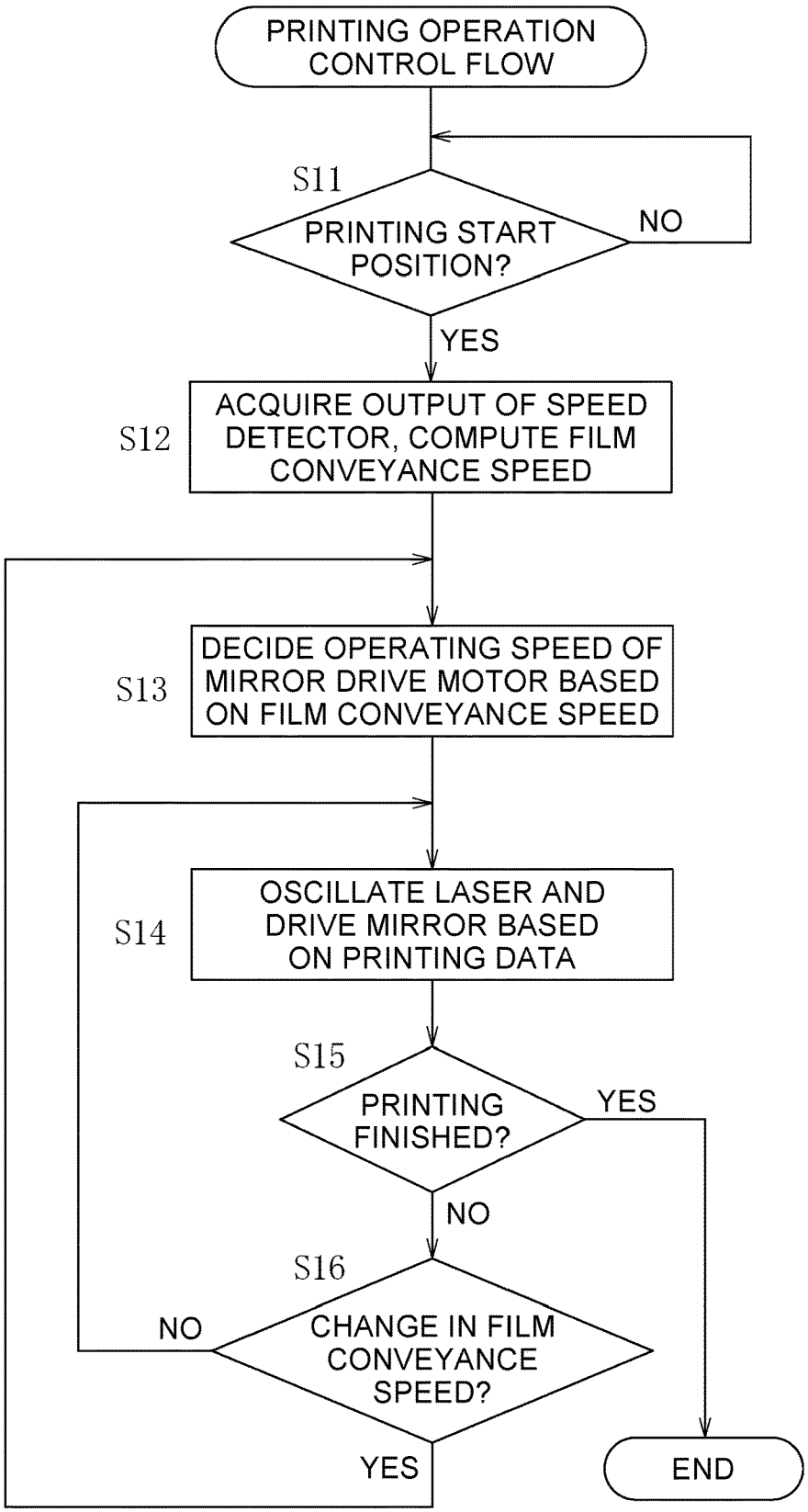
FIG. 5 is a drawing showing a flow of control of printing operations for printing on the film.

FIG. 5 shows a flow of control of printing operations of the printing unit 7 by the control unit 110.

When the film F is continuously or intermittently conveyed and the printed portion F-1 of the film F needing to be printed reaches a position opposing the printing unit 7, it is determined in step S11 that the printed portion F-1 has arrived at a printing start position, and then the control flow moves to step S12.

In step S12, the control unit 110 acquires the measurement data being sent from the speed detector 80 and computes the conveyance speed of the film F based on the measurement data. In step S13, the control unit 110 decides the operating speed of the mirror drive motor 72 based on the conveyance speed of the film F it has found by computation. The operating speed of the mirror drive motor 72 decided in step S13 is a reference operating speed serving as a reference when tracing the path of the laser light represented by the printing data. The operating speed of the mirror drive motor 72 decided in step S13 is set to a slower speed if the conveyance speed of the film F is slower, and is set to a higher speed if the conveyance speed of the film F is higher.

In step S14, the laser oscillation by the laser emitter 71 and the mirror driving by the mirror drive motor 72 are controlled by the control unit 110 based on the printing data stored in the data storage unit 73.

When the film F is intermittently conveyed and the film F does not move between the start of printing and the end of printing, the conveyance speed of the film F is zero, and in step S16 the determination is always that there is no change in the film conveyance speed. When it is determined in step S15 that printing on the film by the printing unit 7 has ended, the flow temporarily stops. Thereafter, the next printing operation control flow is started because whether or not the next printed portion F-1 of the film F has arrived at the printing start position is monitored.

When the film F is continuously conveyed and the film F continues to move between the start of printing and the end of printing, the conveyance speed of the film F is constant or changes. In step S16, it is determined whether or not there has been a change in the conveyance speed of the film F based on the measurement data of the speed detector 80. If there has been a change in the conveyance speed of the film F, the control flow returns to step S13 and the reference operating speed of the mirror drive motor 72 is reset based on the conveyance speed of the film F after the change. In step S14 control of the laser oscillation and the mirror driving is performed using the newly set reference operating speed of the mirror drive motor 72. That is, when the conveyance speed of the film F when the printing unit 7 starts printing the film F changes in the middle of printing the film F, the printing unit 7 changes the operation of printing the film F in accordance with the change in the conveyance speed of the film F.

It will be noted that, also in a case where the film F is being continuously conveyed, the flow temporarily stops when it is determined in step S15 that the printing on the film F by the printing unit 7 has ended. Thereafter, the next printing operation control flow is started because whether or not the next printed portion F-1 of the film F has arrived at the printing start position is monitored.

(8) Characteristics

In conventional packaging apparatus, printing quality sometimes drops due to changes in the conveyance speed of the film. For this reason, conventional packaging apparatus perform printing when the film is stopped or when the conveyance speed of the film does not change.

Furthermore, in vertical pillow bagmaking and packaging apparatus, conventionally, thermal printers have been frequently used as printing devices. Additionally, in the case of a bagmaking and packaging apparatus that can switch between a continuous bagmaking mode in which the film is continuously conveyed and an intermittent bagmaking mode in which the film is intermittently conveyed, a rubber member (a board or a roller) that forms a pair with the thermal printer needs to be changed in conformity with the switch in the mode. This leads to a reduction in the operating efficiency of the packaging apparatus.

These problems in the conventional packaging apparatus can be eliminated by the bagmaking and packaging apparatus 102 of the present embodiment.

(8-1)

In the bagmaking and packaging apparatus 102 of the present embodiment, the operation of the printing unit 7 that is a laser printing device is linked to the conveyance speed of the film F (see step S16 and step S13 of FIG. 5). For this reason, the film F can be printed while maintaining printing quality even at a timing when the conveyance speed of the film F changes. Consequently, limitations on the timing of printing that had existed in conventional packaging apparatus are eliminated, and the operating efficiency of the bagmaking and packaging apparatus 102 becomes better than that of conventional packaging apparatus.

(8-2)

In the bagmaking and packaging apparatus 102 of the present embodiment, the speed detector 80 is provided with the wheel 81 that contacts the film F, and the speed detector 80 acquires, as the measurement data, the rotational speed of the wheel 81 that rotates in accompaniment with the conveyance of the film F. According to this bagmaking and packaging apparatus 102, the wheel 81 that contacts the film F is used to directly obtain the measurement data relating to the conveyance speed of the film F, so the reliability of the measurement data is high and the quality of the printing on the film F can be kept high.

(8-3)

In the bagmaking and packaging apparatus 102 of the present embodiment, the wheel 81 is disposed near the printed portion F-1 of the film F, and the rotational speed of the wheel 81 is acquired as the measurement data relating to the conveyance speed of the film F. According to this bagmaking and packaging apparatus 102, the operation of the printing unit 7 is controlled so as to be linked to the conveyance speed of the film F near the printed portion F-1, so the quality of the printing on the film F becomes extremely high.

(8-4)

In the bagmaking and packaging apparatus 102 of the present embodiment, as shown in step S16 of FIG. 5, whether or not the conveyance speed of the film F has changed in the middle of printing the film F is monitored, and when the conveyance speed of the film F changes, the operation of printing the film F is changed in accordance with the change (see step S13 and step S14 of FIG. 5). According to this bagmaking and packaging apparatus 102, the operation of printing the film F finely changes in conjunction with the conveyance speed of the film F, so the quality of the printing on the film F becomes extremely high both at the time near the start of printing and at the time near the end of printing.

(9) Example Modifications

An embodiment of the present invention has been described above, but the present invention is not limited to the above embodiment, and changes may be made thereto without departing from the spirit of the invention.

(9-1) Example Modification A

In the bagmaking and packaging apparatus 102 of the above embodiment, the control unit 110 is shared by the weighing apparatus 101 and the bagmaking and packaging apparatus 102, but each apparatus may be individually provided with its own control unit. Furthermore, instead of a configuration where the packaging unit 5, the film supply unit 6, and the printing unit 7 are all controlled by the control unit 110, a configuration where each of the units 5, 6, 7 is individually provided with its own control unit can also be employed.

(9-2) Example Modification B

In the bagmaking and packaging apparatus 102 of the above embodiment, the speed detector 80 that presses the wheel 81 against the film F is employed, but instead of this an encoder 180 shown in FIG. 6 may be employed.

The encoder 180 is disposed on an end portion of the roller 61*e* of the film supply unit 6 functioning as a conveyance unit of the film F, and is a device that measures the rotational speed of the roller 61*e*. In example modification B, a cylindrical rubber is fitted on the outer peripheral surface of the roller 61*e*, and the roller 61*e* rotates in accompaniment with the conveyance of the film F. The encoder 180 is, for example, an optical rotary encoder, measures the rotational angle of the roller 61*e*, and sends the obtained measurement data to the control unit 110 as data relating to the conveyance speed of the film F.

Also in a case where the encoder 180 is employed instead of the speed detector 80 in this way, the control unit 110 can perform in the same way control of the printing operations shown in FIG. 5, and the effects described in section "(8) Characteristics" of the above embodiment can be obtained.

Although here the encoder 180 is attached to the end portion of the roller 61*e*, the encoder may be attached to another roller of the film supply unit 6, and the encoder may be attached to a motor for conveying the film F.

REFERENCE SIGNS LIST

6 Film Supply Unit (Conveyance Unit)
7 Printing Unit (Laser Printing Device)
14 Pull-down Belt Mechanisms (Conveyance Unit)
80 Speed Detector (First Information Acquisition Unit)
81 Wheel (Rotating Member)
102 Bagmaking and Packaging Apparatus (Packaging Apparatus)
110 Control Unit
180 Encoder (First Information Acquisition Unit)
F Film
F-1 Printed Portion of Film

What is claimed is:

1. A packaging apparatus that uses a film to package articles, the packaging apparatus comprising:
a conveyance unit that conveys the film;
a laser printing device that sweeps light across the film to print the film;
a first information acquisition unit that acquires first information indicative of the conveyance speed of the film; and
a control unit configured to utilize the first information to control the laser printing device during printing, as the film is being conveyed, based on the conveyance speed of the film,
wherein the control unit is configured such that in the case of the conveyance speed of the film changing in the middle of printing the film, the laser printing device changes the manner of printing the film in accordance with the change in the conveyance speed of the film.

2. The packaging apparatus of claim 1, wherein
the conveyance unit has a rotating member, and
the first information acquisition unit acquires the rotational speed of the rotating member as the first information.

3. The packaging apparatus of claim 1, further comprising a first member that contacts the film and rotates in accompaniment with the conveyance of the film, wherein the first information acquisition unit acquires the rotational speed of the first member as the first information.

4. The packaging apparatus of claim 3, wherein the first member is pressed against the film near a printed portion of the film printed by the laser printing device.

* * * * *